US009558925B2

(12) United States Patent
Ibrahim et al.

(10) Patent No.: US 9,558,925 B2
(45) Date of Patent: Jan. 31, 2017

(54) DEVICE FOR SEPARATING NON-IONS FROM IONS

(71) Applicant: Battelle Memorial Institute, Richland, WA (US)

(72) Inventors: Yehia M. Ibrahim, Richland, WA (US); Richard D. Smith, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 14/256,555

(22) Filed: Apr. 18, 2014

(65) Prior Publication Data

US 2015/0303046 A1 Oct. 22, 2015

(51) Int. Cl.
*H01J 49/06* (2006.01)

(52) U.S. Cl.
CPC ..... *H01J 49/066* (2013.01); *H01J 49/06* (2013.01); *H01J 49/062* (2013.01); *H01J 49/063* (2013.01); *H01J 49/065* (2013.01)

(58) Field of Classification Search
CPC ..... H01J 49/063; H01J 49/065; H01J 49/062; H01J 49/066
See application file for complete search history.

(56) References Cited

U.S. PATENT DOCUMENTS 3,473,020 A * 10/1969 Brubaker ..... 250/290
5,426,301 A 6/1995 Turner
5,939,718 A * 8/1999 Yamada et al. ..... 250/288
6,107,628 A 8/2000 Smith et al.
6,417,511 B1 * 7/2002 Russ et al. ..... 250/292
6,462,338 B1 * 10/2002 Inatsugu et al. ..... 250/292
6,583,408 B2 6/2003 Smith et al.
6,730,904 B1 * 5/2004 Wells ..... 250/292
6,787,760 B2 9/2004 Belov et al.
6,803,565 B2 10/2004 Smith et al.
6,818,890 B1 11/2004 Smith et al.
6,831,274 B2 12/2004 Smith et al.
6,967,325 B2 11/2005 Smith et al.
6,979,816 B2 12/2005 Tang et al.
7,148,474 B2 12/2006 Tang et al.
7,170,053 B2 1/2007 Shvartsburg et al.
7,339,166 B2 3/2008 Tang et al.
7,351,964 B2 4/2008 Tolmachev et al.
7,491,930 B2 2/2009 Shvartsburg et al.
7,495,212 B2 * 2/2009 Kim ..... H01J 49/066 250/292
7,514,676 B1 4/2009 Page et al.
(Continued)

FOREIGN PATENT DOCUMENTS

EP 0771019 A1 5/1997
GB 2492664 A 1/2013

OTHER PUBLICATIONS

International Search Report/Written Opinion for International Application No. PCT/US205/016402, International Filing Date Feb. 18, 2015, Date of Mailing Jun. 19, 2015.

*Primary Examiner* — Michael Logie
(74) *Attorney, Agent, or Firm* — Klarquist Sparkman, LLP

(57) ABSTRACT

A device for separating non-ions from ions is disclosed. The device includes a plurality of electrodes positioned around a center axis of the device and having apertures therein through which the ions are transmitted. An inner diameter of the apertures varies in length. At least a portion of the center axis between the electrodes is non-linear.

16 Claims, 7 Drawing Sheets

(56) References Cited

U.S. PATENT DOCUMENTS 7,541,576 B2 6/2009 Belov et al.
7,671,344 B2 3/2010 Tang et al.
7,838,826 B1 11/2010 Park
7,888,635 B2 2/2011 Belov et al.
8,173,960 B2 5/2012 Tang et al.
8,222,597 B2 7/2012 Kim et al.
8,263,930 B2 9/2012 Tang et al.
8,299,443 B1 10/2012 Shvartsburg et al.
8,324,565 B2 12/2012 Mordehai et al.
8,507,850 B2 * 8/2013 Whitehouse et al. ..... 250/288
8,642,949 B2 2/2014 Makarov et al.
2003/0155496 A1 * 8/2003 Kalinitchenko ..... 250/281
2004/0026614 A1 * 2/2004 Bateman ..... H01J 49/065 250/281
2004/0046124 A1 * 3/2004 Derrick et al. ..... 250/396 R
2004/0195503 A1 * 10/2004 Kim ..... H01J 49/066 250/288
2008/0308721 A1 * 12/2008 Senko ..... H01J 3/14 250/281
2009/0026361 A1 * 1/2009 Syms et al. ..... 250/281
2009/0045062 A1 * 2/2009 Senko ..... H01J 49/065 204/547
2009/0159796 A1 * 6/2009 Belford et al. ..... 250/294
2009/0212210 A1 * 8/2009 Finlay et al. ..... 250/288
2009/0266984 A1 * 10/2009 Hirano ..... 250/288
2009/0321655 A1 * 12/2009 Makarov ..... H01J 49/065 250/396 R
2010/0038532 A1 * 2/2010 Makarov ..... H01J 49/062 250/288
2010/0176295 A1 * 7/2010 Senko et al. ..... 250/292
2010/0301227 A1 * 12/2010 Muntean ..... 250/396 R
2010/0308218 A1 * 12/2010 Wang ..... 250/292
2011/0049357 A1 3/2011 Giles
2011/0147575 A1 * 6/2011 Mordehai ..... H01J 49/066 250/282
2011/0278450 A1 * 11/2011 Loucks et al. ..... 250/290
2012/0223244 A1 * 9/2012 Welkie ..... H01J 37/12 250/396 ML
2012/0248304 A1 * 10/2012 Dunyach et al. ..... 250/288
2013/0187044 A1 * 7/2013 Ding et al. ..... 250/292
2014/0048695 A1 * 2/2014 Giles ..... H01J 49/065 250/281
2014/0103206 A1 * 4/2014 Mukaibatake et al. ..... 250/288
2014/0151546 A1 * 6/2014 Li et al. ..... 250/282
2014/0312243 A1 * 10/2014 Kalinitchenko ..... 250/396 R
2014/0332694 A1 * 11/2014 Kovtoun et al. ..... 250/396 R
2014/0339414 A1 * 11/2014 Loboda ..... 250/281
2014/0353493 A1 * 12/2014 Mordehai ..... H01J 49/062 250/287
2015/0034814 A1 * 2/2015 Brown ..... H01J 49/164 250/282
2015/0060655 A1 * 3/2015 Garside et al. ..... 250/281

* cited by examiner

DEVICE FOR SEPARATING NON-IONS FROM IONS

STATEMENT REGARDING FEDERALLY SPONSORED RESEARCH OR DEVELOPMENT

The invention was made with Government support under Contract DE-AC05-76RL01830, awarded by the U.S. Department of Energy, and Grant No. R21 GM103497 awarded by the National Institutes of Health. The Government has certain rights in the invention.

TECHNICAL FIELD

This invention relates to ion transport devices. More specifically, this invention relates to a device for separating non-ions from ions.

BACKGROUND OF THE INVENTION

Ion funnels are increasingly being used in mass spectrometers to improve sensitivity. Ion funnels collect diffuse ion plumes from ion sources, utilizing a large entrance, and then focus the ion beam by progressively reducing the inner diameter of the circular apertures. A 180° out-of-phase RF waveform is applied to adjacent circular apertures to confine ions radially and prevent their loss to the electrodes. A DC gradient is applied to create a driving force for ions to be transported through the funnel.

An example of a prior art ion funnel is shown in FIG. 1. The ion funnel 100 consists of a stack of electrodes 110 the inner apertures of which progressively decrease along the funnel. The ion funnel has an entry 150 corresponding with the largest aperture, and an exit 160 corresponding with the smallest aperture. As shown in FIG. 1 the entrance 150 and exit 160 are on a line-of-sight, and the center axis 120 between the electrodes 110 is a straight line with no offset.

Ion plumes that are introduced into the ion funnel are accompanied by expanding gas that contains partially solvated ions, droplets, and neutral particles. In cases where large gas loads enter the funnel from, e.g., multi-inlet or large bore inlets these non-ionic particles have significantly adverse effect on the performance of the ion funnel as well as the ion optics downstream of the ion funnel. These adverse effects lead to non-robust operations and frequent instrument downtime for cleaning ion topics.

SUMMARY OF THE INVENTION

The present invention is directed to methods and devices for separating non-ions from ions. In one embodiment, the device includes a plurality of electrodes positioned around a center axis of the device and having apertures therein through which the ions are transmitted. An inner diameter of the apertures varies in length. At least a portion of the center axis between the electrodes is non-linear.

In one embodiment, at least a portion of the non-linear center axis is bent, curved, or angled.

In one embodiment, the device further includes a line of sight from an entrance to an exit of the device, wherein at least a portion of the line of sight is obstructed.

In one embodiment, the non-ions hit, or are deposited on, a surface of the electrodes. The non-ions may be pumped away from in between the electrodes. In one embodiment, the electrodes are ring electrodes.

In one embodiment, the inner diameter of the apertures varies non-linearly from an entrance of the device to an exit of the device. The apertures may be circular or non-circular.

In one embodiment, the inner diameter of the apertures is larger at bends than elsewhere in the device. The inner diameter of the apertures may be smaller or larger than the inner diameter of a preceding aperture.

The device may also include an RF voltage applied to each of the electrodes and a DC gradient applied across the plurality of electrodes. In one embodiment, the RF applied to each of the electrodes is 180 degrees out of phase with the RF applied to adjacent electrodes.

In another embodiment of the present invention, a method of separating non-ions from ions in a device is disclosed. The method includes positioning a plurality of electrodes around a center axis of the device and transmitting the ions through apertures of the electrodes. An inner diameter of the apertures varies in length, and at least a portion of the center axis between the electrodes is non-linear.

In another embodiment of the present invention, a device for separating non-ions from ions is disclosed. The device includes a plurality of electrodes positioned around a center axis of the device and having apertures through which the ions are transmitted. An inner diameter of the apertures varies in length, and at least a portion of the center axis between the electrodes is non-linear. The device also includes a line of sight from an entrance of the device to an exit of the device, wherein at least a portion of the line of sight is obstructed. The portion of the non-linear center axis is, but not limited to being, bent, curved, or angled.

DETAILED DESCRIPTION OF THE PREFERRED EMBODIMENTS

The present invention is directed to devices and methods of separating non-ions, such as droplets, neutral particles and other non-ionic particles, from ions. At least a portion of the center axis between electrodes of the device is non-linear—e.g., bent, curved, or angled—and offset in a certain direction or plane. Thus, the center of axis of the device is not entirely a straight line but rather a broken or curved line. When ionic as well as non-ionic species are introduced into the device and flow through apertures of the electrodes, only ions curve or bend around and follow the center axis of the device when a pseudopotential and a DC gradient is applied to the device—while non-ionic get pumped away from in between the electrodes. Further, at least a portion of the line of sight from the entrance of the device to the exit of the device is obstructed. In other words, the device breaks the line of sight feature of prior ion funnels.

The inner diameter of the apertures may vary in length and vary non-linearly from an entrance of the device to an exit of the device. In one embodiment, the inner diameter of the apertures is larger at the bends than elsewhere in the device.

Figure 1:
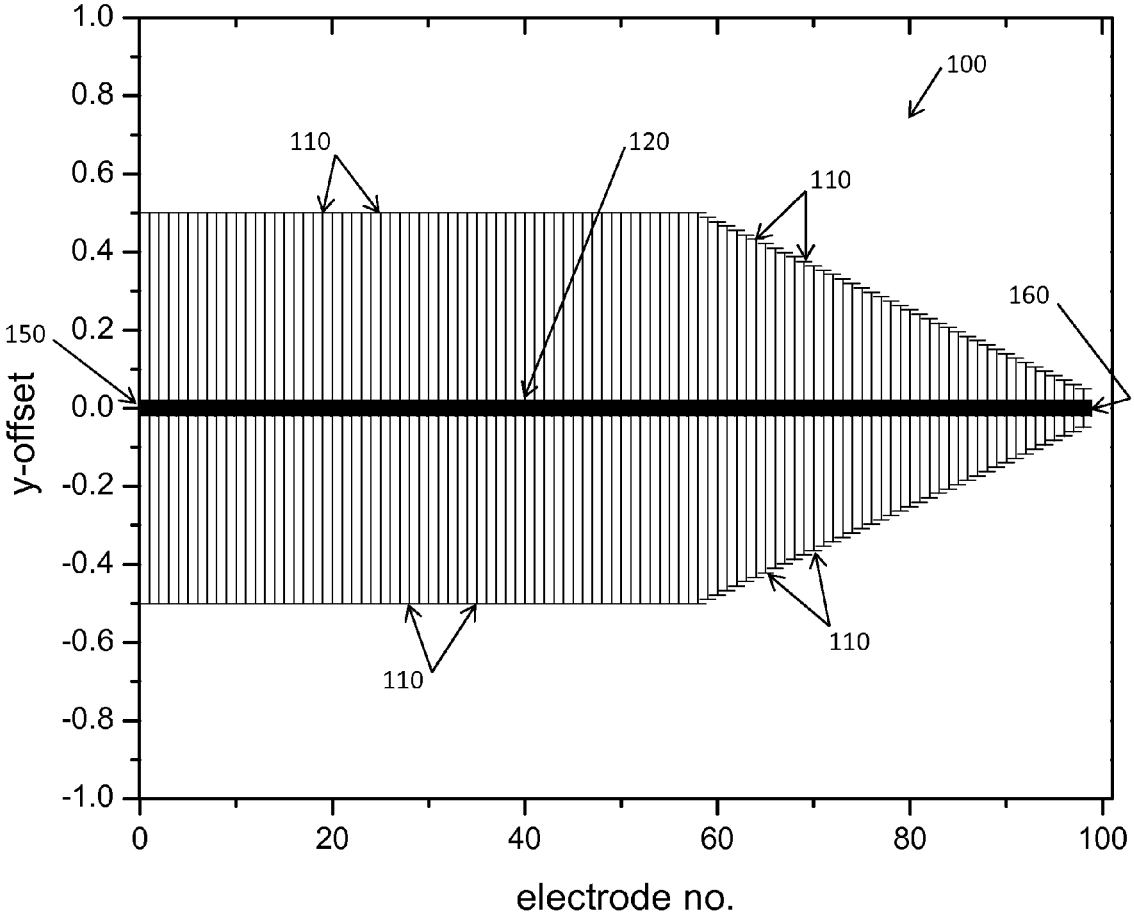
Figure 1 (Prior Art)
FIG. 1 is a prior art schematic of an ion funnel device with no offset in the y-axis.
Figure 2:
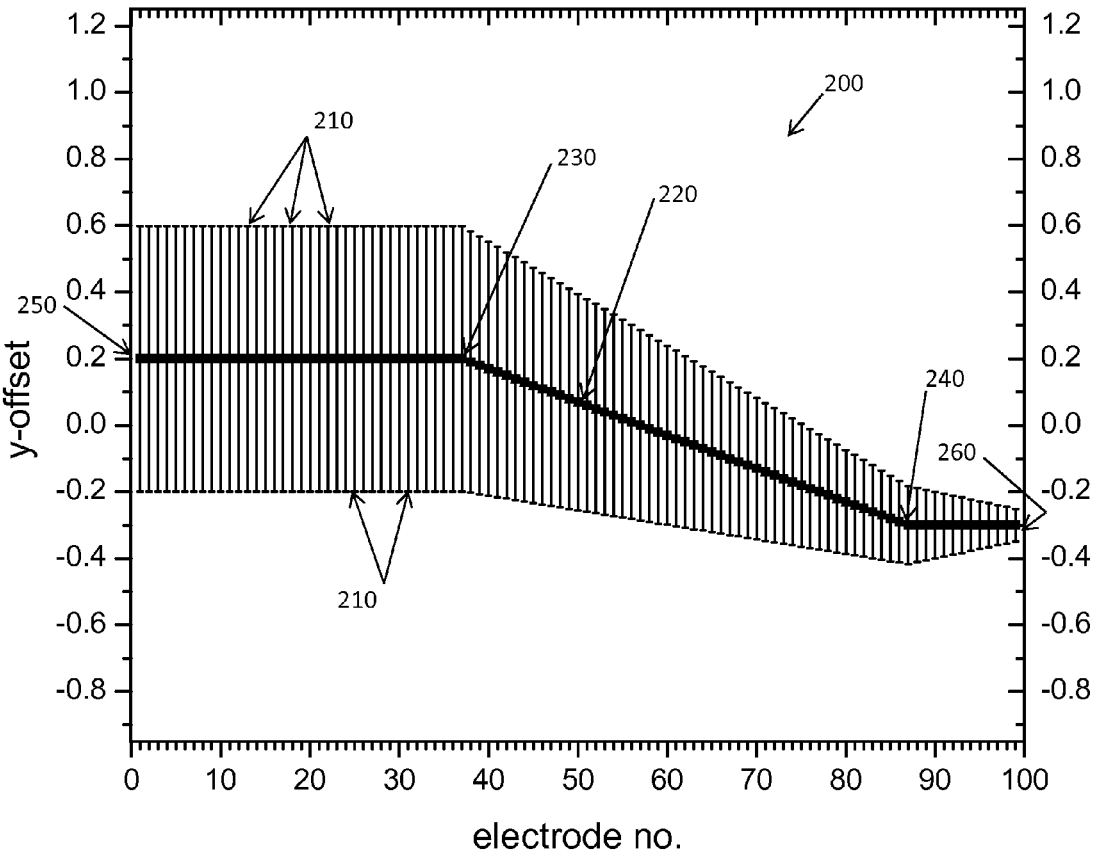
FIG. 2 is a schematic of a device for separating ions from non-ions, wherein at least a portion of the center axis between the electrodes is bent and offset in the y-axis, in accordance with one embodiment of the present invention.

FIG. 2 is a schematic of a device 200 for separating non-ions from ions, wherein at least a portion of the center axis between the electrodes is bent and offset in the y-axis, in accordance with one embodiment of the present invention. The device includes a plurality of electrodes 210 positioned around a center axis 230 of the device 200 and having apertures therein through which the ions are transmitted. An inner diameter of the apertures varies in length from an entrance 250 to an exit 260 of the device 200. At least a portion of the center axis 220 between the electrodes 210 is non-linear. When ions as well as non-ionic species are introduced into the device 200 only ions curve around and follow the center axis 220 of the device 200—when guided by RF and DC voltages—and get pumped away from in between the electrodes 210.

In the embodiment of FIG. 2, a portion of the non-linear center axis 220 is bent. The device 200 includes a first bend 230 near electrode number 37 and a second bend 240 near electrode number 87. It should be noted that the center axis 220 can include any number of bends, curves, or angles at various locations of the device 200.

In one embodiment, the inner diameter of the apertures, which can be non-linear, is larger at the bends than elsewhere in the device 200. Also, a portion of the line of sight from the entrance 250 to the exit 260 is obstructed.

The device can include any number of electrodes and be any length. In one embodiment, which should not be construed as limiting, the device includes at least 100 electrodes and has a minimum length of about 7.5 inches. In some embodiments, the path length is less than the path length of dual ion funnels. In some embodiments, the device includes at least 125 electrodes.

Figure 3:
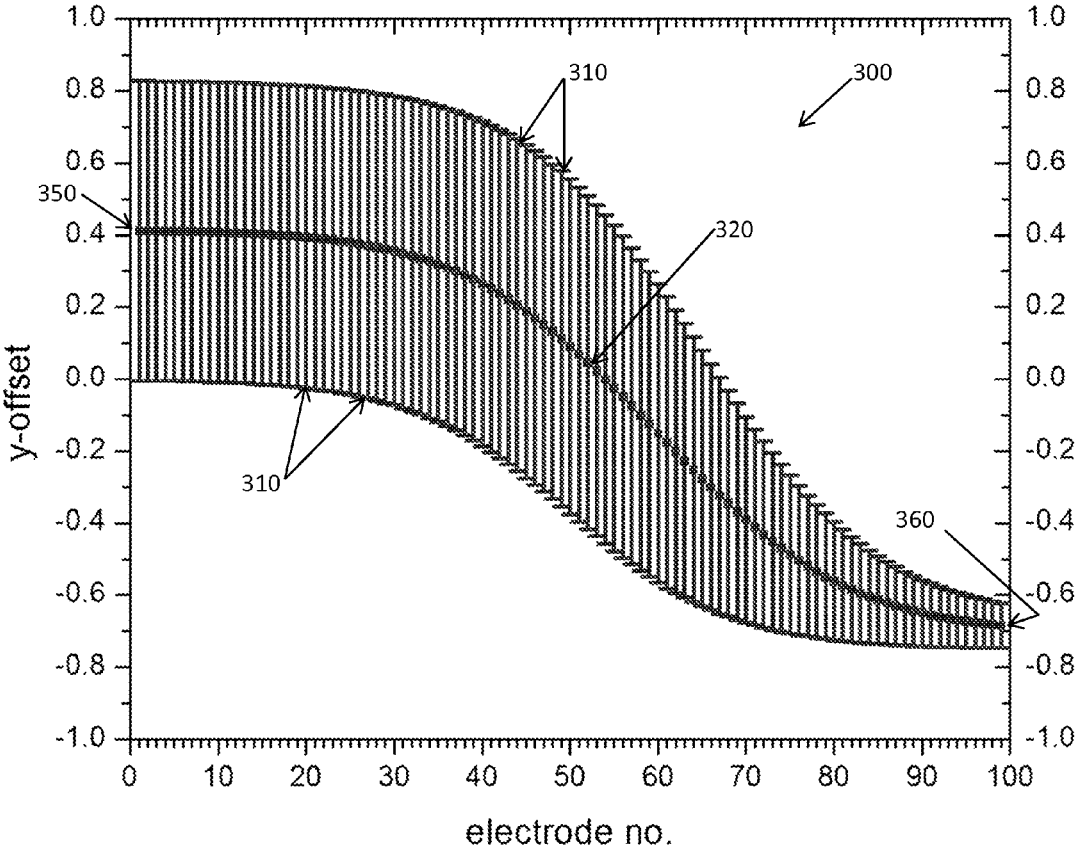
FIG. 3 is a schematic of a device for separating ions from non-ions, wherein at least a portion of the center axis between the electrodes is curved and offset in the y-axis, in accordance with one embodiment of the present invention.

FIG. 3 is a schematic of a device 300 for separating ions from non-ions, wherein at least a portion of the center axis 320 between the electrodes 310 is curved and offset in the y-axis, in accordance with one embodiment of the present invention. An inner diameter of the apertures varies in length from an entrance 350 to an exit 360 of the device 300. Many of the details of the device 300 described in connection with FIG. 3 are common to those provided in the description of FIG. 2 and are not repeated to avoid obscuring the description of the presently described embodiments.

Figure 4:
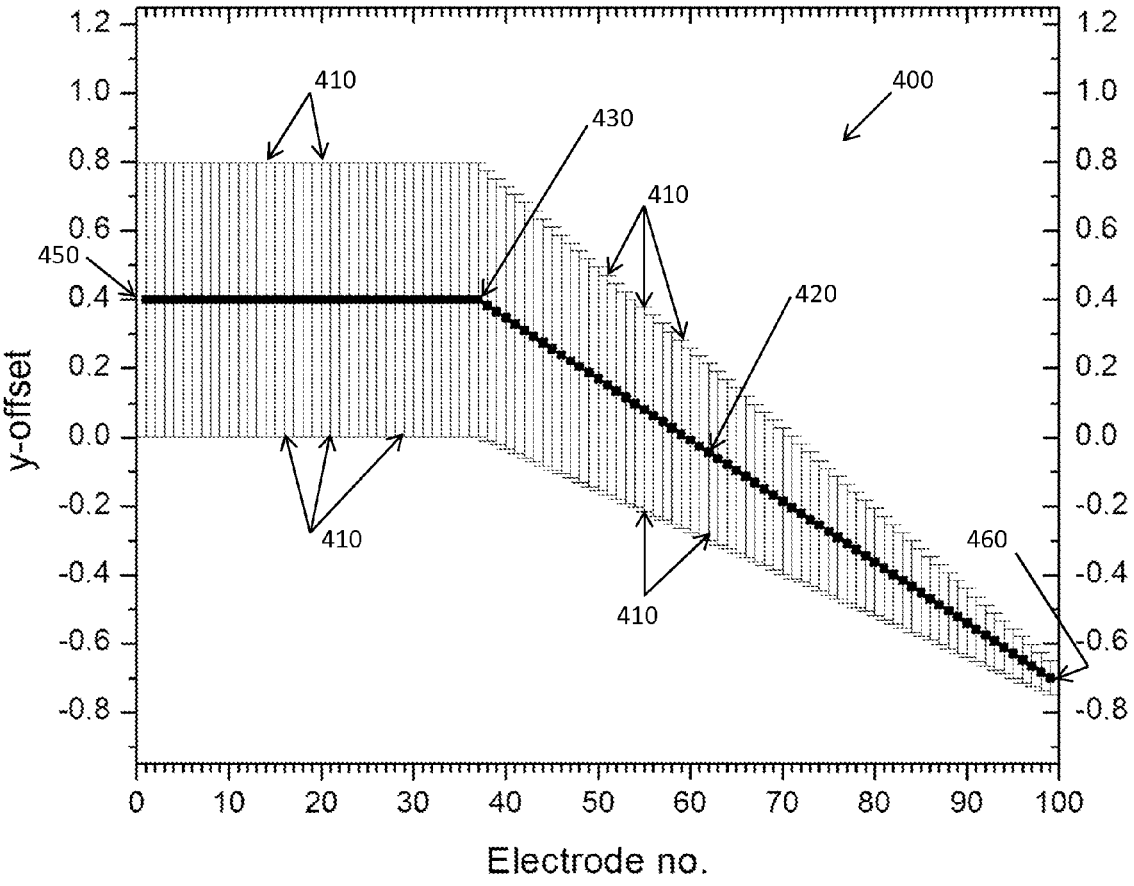
FIG. 4 is a schematic of a device for separating ions from non-ions, wherein at least a portion of the center axis between the electrodes is bent and offset in the y-axis, in accordance with one embodiment of the present invention.

FIG. 4 is a schematic of a device 400 for separating ions from non-ions, wherein at least a portion of the center axis 420 between the electrodes is bent and offset in the y-axis, in accordance with one embodiment of the present invention. The device 400 includes a bend 430 near electrode number 38. An inner diameter of the apertures varies in length from an entrance 450 to an exit 460 of the device 400. Many of the details of the device 400 described in connection with FIG. 4 are common to those provided in the description of FIGS. 2 and 3 and are not repeated to avoid obscuring the description of the presently described embodiments.

Figure 5:
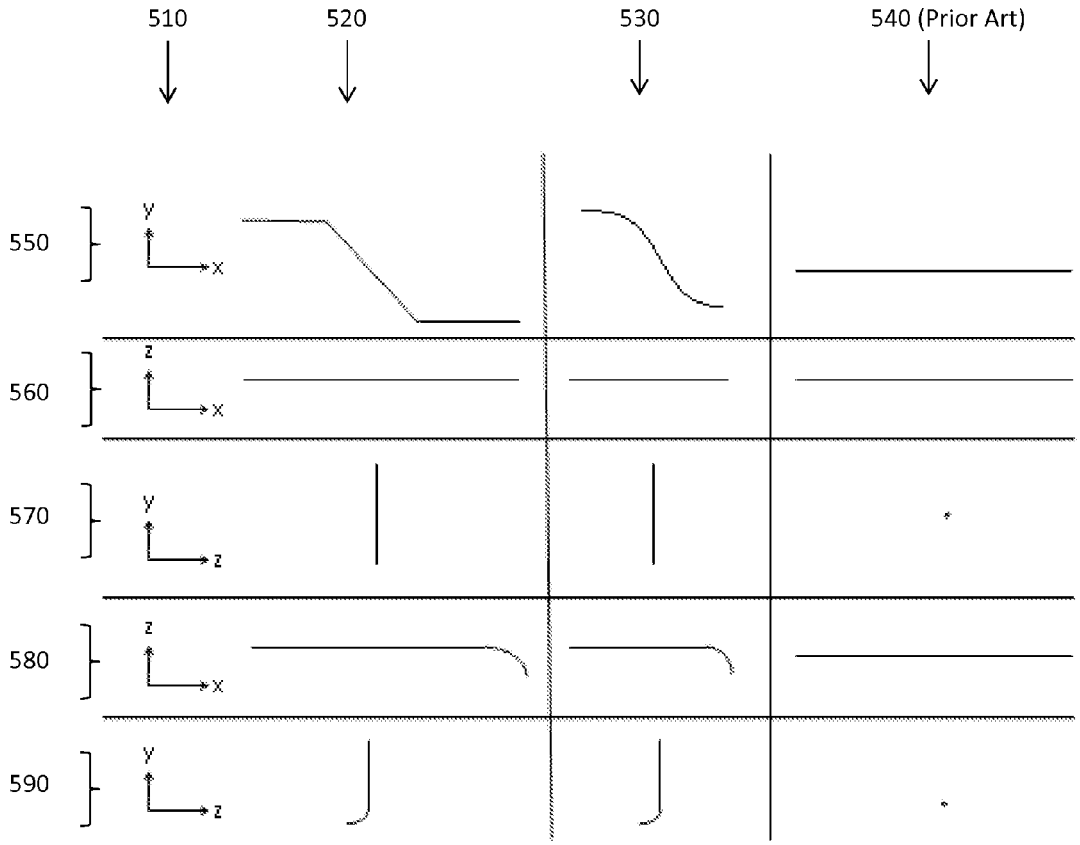
FIG. 5 shows different variations on the center axis offset, with at least a portion of the center axis bent, curved or straight in certain planes.

FIG. 5 shows different variations on the center axis offset, with at least a portion of the center axis bent, curved or straight (prior art) in certain planes. Three columns 520, 530, and 540 of different variations on the center axis offset are shown for any number of directions or planes in column 510. Column 520 depicts various views for a center axis that is bent; column 530 depicts various views for a center axis that is curved; and column 540 depicts various views for a prior art center axis that is straight. Row 550 shows the various views of each center axis when the offset is in the y-axis. Row 560 shows the various views of each center axis in the x-z plane, with no offset. Row 570 shows the various views of each center axis in the y-z plane, with no offset. The center axis for the straight line of column 540 is seen as a point (or dot) in the y-z plane. Row 580 shows the various views of each center axis in the x-z plane for a different embodiment of the device. Row 590 shows the various views of each center axis in the y-z plane for a different embodiment of the device. It should be noted that the device can combine offsets, resulting in double, triple or more offsets.

Figure 6:
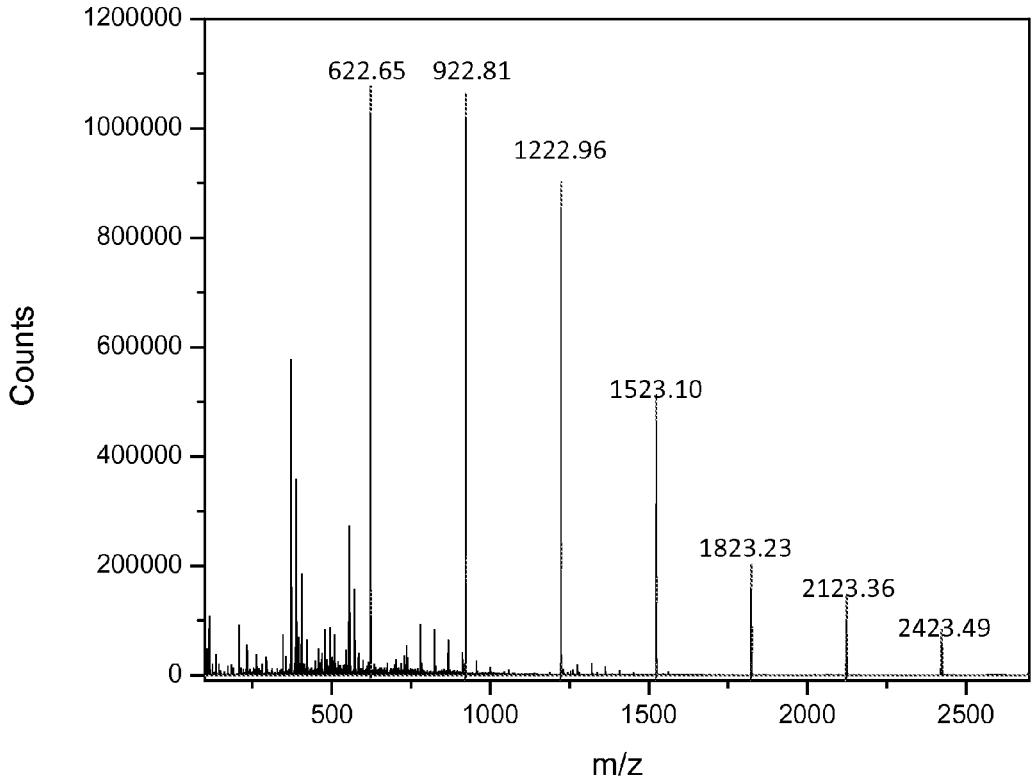
FIG. 6 shows the mass spectra of a fluorophosphazine compound using the device of FIG. 2.

FIG. 6 shows the mass spectra of a fluorophosphazine compound using the device of FIG. 2. Ions with different m/z ratios are transmitted with no degradation of performance due to bending (or curving) of the device.

Figure 7:
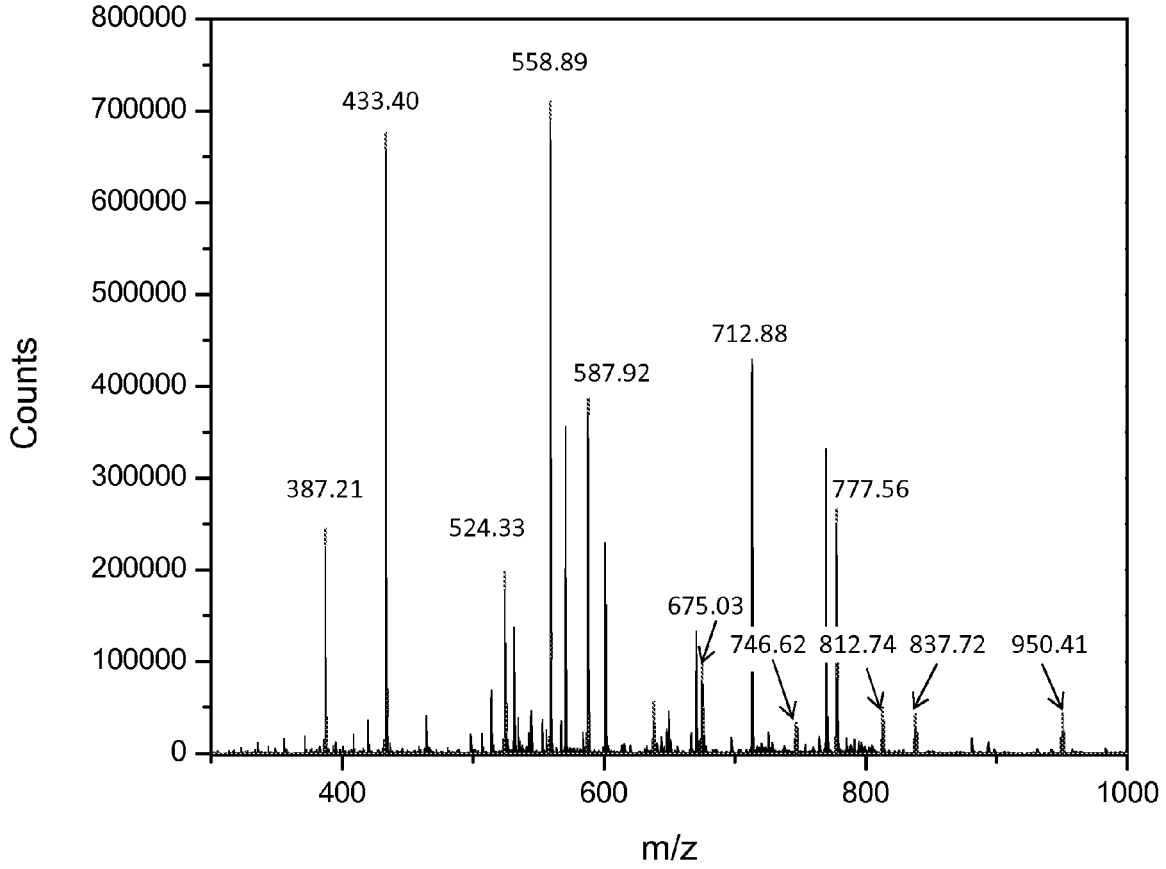
FIG. 7 shows the mass spectra of a mixture of peptides using the device of FIG. 2.

FIG. 7 shows the mass spectra of a mixture of peptides using the device of FIG. 2. Ions with different m/z ratios are transmitted with no degradation of performance due to bending (or curving) of the device.

In some embodiments, the device may be fabricated using printed circuit board technology, assembled and tested. The electronic circuitry may be designed using commercial software.

The device is also easy to clean, exhibits enhanced sensitivity and improved longevity and reproducibility.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

We claim:

1. A single ion funnel device for separating non-ions from ions traveling in a downstream direction comprising:

a plurality of electrodes positioned around a center axis of the device and having apertures therein through which the ions are transmitted, wherein an inner diameter of the apertures varies in length and non-linearly from an entrance of the device to an exit of the device, a line of sight from the entrance of the device to the exit of the device, wherein at least a portion of the line of sight is obstructed; and wherein at least a portion of the center axis between the electrodes is non-linear and offset; and a RF voltage applied to each of the electrodes and a DC gradient applied across the plurality of electrodes, wherein the non-ions are pumped away from in between the electrodes;

wherein the inner diameter of at least one aperture of the apertures is smaller than the inner diameter of another aperture situated at a bend variation of the center axis downstream from the at least one aperture.

2. The device of claim 1 wherein the portion of the non-linear center axis is bent, curved, or angled.

3. The device of claim 1 wherein the inner diameter of the apertures is larger at bends than elsewhere in the device.

4. The device of claim 1 wherein the apertures includes at least some apertures wherein the inner diameter of the at least some apertures is smaller than an inner diameter of a preceding aperture.

5. The device of claim 1 wherein the apertures are circular.

6. The device of claim 1 wherein the apertures are non-circular.

7. The device of claim 1 wherein the RF voltage applied to each of the electrodes is 180 degrees out of phase with the RF voltage applied to adjacent electrodes.

8. The device of claim 1 wherein the length is at least about 7.5 inches and the plurality of electrodes include at least 125 electrodes.

9. A method of separating non-ions from ions traveling in a downstream direction in a single ion funnel device comprising:

a. positioning a plurality of electrodes around a center axis of the device;

b. transmitting the ions through apertures of the plurality of electrodes, wherein an inner diameter of the apertures varies in length and non-linearly from an entrance of the device to an exit of the device, wherein at least a portion of the center axis between the electrodes is non-linear and offset, and wherein the inner diameter of at least one aperture of the apertures is smaller than the inner diameter of another aperture situated at a bend variation of the center axis downstream from the at least one aperture;

c. a line of sight from the entrance of the device to the exit of the device, wherein at least a portion of the line of sight is obstructed; and d. applying a RF voltage to each of the electrodes and applying a DC gradient across the plurality of electrodes, wherein the non-ions are pumped away from in between the electrodes.

10. The method of claim 9 wherein the inner diameter of the apertures is larger at bends than elsewhere in the device.

11. The method of claim 9 wherein the apertures includes at least some apertures wherein the inner diameter of the at least some apertures is smaller than an inner diameter of a preceding aperture.

12. The method of claim 9 wherein the apertures are circular.

13. The method of claim 9 wherein the apertures are non-circular.

14. The method of claim 9 wherein the RF voltage applied to each of the electrodes is 180 degrees out of phase with the RF voltage applied to adjacent electrodes.

15. A single ion funnel device for separating non-ions from ions traveling in a downstream direction comprising:

a. a plurality of electrodes positioned around a center axis of the device and having apertures therein through which the ions are transmitted, wherein an inner diameter of the apertures varies in length and varies non-linearly from an entrance of the device to an exit of the device, and wherein the inner diameter of the apertures is larger at bends than elsewhere in the device such that at least one aperture of the apertures is smaller than the inner diameter of another aperture situated at a bend variation of the center axis downstream from the at least one aperture;

b. a line of sight from an entrance of the device to an exit of the device, wherein at least a portion of the line of sight is obstructed and a portion of the center axis between the electrodes is offset; and c. a RF voltage applied to each of the electrodes and a DC gradient applied across the plurality of electrodes.

16. The device of claim 15 wherein the portion of the non-linear center axis is bent, curved, or angled.

* * * * *